US005924062A

United States Patent [19]

Maung

[11] Patent Number: 5,924,062

[45] Date of Patent: Jul. 13, 1999

[54] ACLEP CODEC WITH MODIFIED AUTOCORRELATION MATRIX STORAGE AND SEARCH

[75] Inventor: Tin Maung, Lewisville, Tex.

[73] Assignee: Nokia Mobile Phones, Finland

[21] Appl. No.: 08/886,609

[22] Filed: Jul. 1, 1997

[51] Int. Cl.[6] ..... G10L 9/08

[52] U.S. Cl. ..... 704/219; 704/217; 704/220; 704/229; 704/222

[58] Field of Search ..... 704/219, 217, 704/220, 229, 222, 223, 232, 230

[56] References Cited

U.S. PATENT DOCUMENTS

| | | | |
|---|---|---|---|
| 4,718,087 | 1/1988 | Papamichalis | 704/222 |
| 4,868,867 | 9/1989 | Davidson et al. | 704/230 |
| 5,091,945 | 2/1992 | Kleijn | 704/217 |
| 5,179,594 | 1/1993 | Yip et al. | 704/217 |
| 5,230,036 | 7/1993 | Akamine et al. | 704/200 |
| 5,434,947 | 7/1995 | Gerson et al. | 704/219 |
| 5,444,816 | 8/1995 | Adoul et al. | 395/2.28 |
| 5,457,783 | 10/1995 | Chhatwal | 704/219 |
| 5,491,771 | 2/1996 | Gupta et al. | 395/2.32 |
| 5,495,555 | 2/1996 | Swaminathan | 704/207 |
| 5,602,961 | 2/1997 | Kolesnik et al. | 704/223 |
| 5,682,407 | 10/1997 | Funaki | 375/240 |
| 5,699,482 | 12/1997 | Adoul et al. | 704/219 |
| 5,717,825 | 2/1998 | Lamblin | 704/223 |

OTHER PUBLICATIONS

"Code–Excited Linear Prediction (CELP): High–Quality Speech at Very Low Bit Rates", Manfred R. Schroeder et al., ICASSP 85 Proceedings, vol. 3, Mar. 26–29, 1985, pp. 937–940.

"Low–Delay Code–Excited Linear–Predictive Coding of Wideband Speech at 32 KBPS", Erik Ordentlich et al., ICASSP 91, Speech Processing 1, vol. 1, May 14–17, 1991, pp. 9–12.

"16 KBPS Wideband Speech Coding Technique Based on Algebraic CELP", C. Laflamme et al., ICASSP 91, Speech Processing 1, vol. 1, May 14–17, 1991, pp. 13–16.

"Wideband CELP Speech Coding at 16 KBits/Sec", Guylain Roy et al., ICASSP 91, Speech Processing 1, vol. 1, May 14–17, 1991, pp. 17–20.

"Derivation of Efficient CELP Coding Algorithms Using the Z–Transform Approach", A. Le Guyader et al., ICASSP 91, Speech Processing 1, vol. 1, May 14–17, 1991, pp. 209–212.

"4kb/s Improved CELP Coder with Efficient Vector Quantization", Kazunori Ozawa et al., ICASSP 91, Speech Processing 1, vol. 1, May 14–17, 1991, pp. 213–216.

"CELP Speech Coding with Almost No Codebook Search", Christian G. Gerlach, ICASSP–94, $S_2$AUVN, vol. 2, Apr. 19–22, 1994, pp. II–109–II–112.

"A Toll Quality 8 Kb/s Speech Codec for the Personal Communications System (PCS)", Redwan Salami et al., IEEE Transactions on Vehicular Technology, vol. 43, No. 3, Aug. 1994, pp. 808–816.

(List continued on next page.)

*Primary Examiner*—David R. Hudspeth
*Assistant Examiner*—Vijay B. Chawan
*Attorney, Agent, or Firm*—Brown, Martin Haller & McClain

[57] ABSTRACT

A codebook correlation matrix comprises a Toeplitz-type (diagonally symmetric) matrix which is calculated from a forty sample subframe of a speech signal, forming a 40×40 matrix. The resulting correlation coefficients which constitute the codes are stored within a DSP's local memory after calculation by dividing the matrix into five predefined x- and y- tracks, each track having a unique set of eight pulse positions. Using the eight pulse positions on each track, fifteen 8×8 sub-matrices are created which include all of the correlation coefficients in the original 40×40 matrix. The sub-matrices are distributed within a 5×5 mapping matrix which is correlated with a structure mapping matrix to determine the configuration of the resulting autocorrelation matrix for storage and searching. The sub-matrices within each column of correlated mapping matrices are searched by directing a multiplex pointer to that particular column.

24 Claims, 11 Drawing Sheets

OTHER PUBLICATIONS

"A Low–Complexity Toll–Quality Variable Bit Rate Coder for CDMA Cellular Systems", Peter Kroon et al., The 1995 International Conference on Acoustics, Speech, and Signal Processing, Conference Proceedings, vol. 1: Speech, May 9–12, 1995, pp. 5–8.

"PCS–1900 Standard EFR–ACELP Speech Codec at 13 kb/s", Draft recommendation, Version 1.1, Apr. 1995, pp. 1–29.

| | 0 | 5 | 10 | 15 | 20 | 25 | 30 | 35 |
|---|---|---|---|---|---|---|---|---|
| 0 | 0,0 | 5,0 | 10,0 | 15,0 | 20,0 | 25,0 | 30,0 | 35,0 |
| 5 | 0,5 | 5,5 | 10,5 | 15,5 | 20,5 | 25,5 | 30,5 | 35,5 |
| 10 | 0,10 | 5,10 | 10,10 | 15,10 | 20,10 | 25,10 | 30,10 | 35,10 |
| 15 | 0,15 | 5,15 | 10,15 | 15,15 | 20,15 | 25,15 | 30,15 | 35,15 |
| 20 | 0,20 | 5,20 | 10,20 | 15,20 | 20,20 | 25,20 | 30,20 | 35,20 |
| 25 | 0,25 | 5,25 | 10,25 | 15,25 | 20,25 | 25,25 | 30,25 | 35,25 |
| 30 | 0,30 | 5,30 | 10,30 | 15,30 | 20,30 | 25,30 | 30,30 | 35,30 |
| 35 | 0,35 | 5,35 | 10,35 | 15,35 | 20,35 | 25,35 | 30,35 | 35,35 |

rr [0][0]

FIG.5a

| | 1 | 6 | 11 | 16 | 21 | 26 | 31 | 36 |
|---|---|---|---|---|---|---|---|---|
| 1 | 1,1 | 6,1 | 11,1 | 16,1 | 21,1 | 26,1 | 31,1 | 36,1 |
| 6 | 1,6 | 6,6 | 11,6 | 16,6 | 21,6 | 26,6 | 31,6 | 36,6 |
| 11 | 1,11 | 6,11 | 11,11 | 16,11 | 21,11 | 26,11 | 31,11 | 36,11 |
| 16 | 1,16 | 6,16 | 11,16 | 16,16 | 21,16 | 26,16 | 31,16 | 36,16 |
| 21 | 1,21 | 6,21 | 11,21 | 16,21 | 21,21 | 26,21 | 31,21 | 36,21 |
| 26 | 1,26 | 6,26 | 11,26 | 16,26 | 21,26 | 26,26 | 31,26 | 36,26 |
| 31 | 1,31 | 6,31 | 11,31 | 16,31 | 21,31 | 26,31 | 31,31 | 36,31 |
| 36 | 1,36 | 6,36 | 11,36 | 16,36 | 21,36 | 26,36 | 31,36 | 36,36 |

rr [1][1]

FIG.5b

| | 2 | 7 | 12 | 17 | 22 | 27 | 32 | 37 |
|---|---|---|---|---|---|---|---|---|
| 2 | 2,2 | 7,2 | 12,2 | 17,2 | 22,2 | 27,2 | 32,2 | 37,2 |
| 7 | 2,7 | 7,7 | 12,7 | 17,7 | 22,7 | 27,7 | 32,7 | 37,7 |
| 12 | 2,12 | 7,12 | 12,12 | 17,12 | 22,12 | 27,12 | 32,12 | 37,12 |
| 17 | 2,17 | 7,17 | 12,17 | 17,17 | 22,17 | 27,17 | 32,17 | 37,17 |
| 22 | 2,22 | 7,22 | 12,22 | 17,22 | 22,22 | 27,22 | 32,22 | 37,22 |
| 27 | 2,27 | 7,27 | 12,27 | 17,27 | 22,27 | 27,27 | 32,27 | 37,37 |
| 32 | 2,32 | 7,32 | 12,32 | 17,32 | 22,32 | 27,32 | 32,32 | 37,37 |
| 37 | 2,37 | 7,37 | 12,37 | 17,37 | 22,37 | 27,37 | 32,37 | 37,37 |

rr [2][2]

FIG.5c

| | 3 | 8 | 13 | 18 | 23 | 28 | 33 | 38 |
|---|---|---|---|---|---|---|---|---|
| 3 | 3,3 | 8,3 | 13,3 | 18,3 | 23,3 | 28,3 | 33,3 | 38,3 |
| 8 | 3,8 | 8,8 | 13,8 | 18,8 | 23,8 | 28,8 | 33,8 | 38,8 |
| 13 | 3,13 | 8,13 | 13,13 | 18,13 | 23,13 | 28,13 | 33,13 | 38,13 |
| 18 | 3,18 | 8,18 | 13,18 | 18,18 | 23,18 | 28,18 | 33,18 | 38,18 |
| 23 | 3,23 | 8,23 | 13,23 | 18,23 | 23,23 | 28,23 | 33,23 | 38,23 |
| 28 | 3,28 | 8,28 | 13,28 | 18,28 | 23,28 | 28,28 | 33,28 | 38,28 |
| 33 | 3,33 | 8,33 | 13,33 | 18,33 | 23,33 | 28,33 | 33,33 | 38,33 |
| 38 | 3,38 | 8,38 | 13,38 | 18,38 | 23,38 | 28,38 | 33,38 | 38,38 |

rr [3][3]

FIG. 5d

| | 4 | 9 | 14 | 19 | 24 | 29 | 34 | 39 |
|---|---|---|---|---|---|---|---|---|
| 4 | 4,4 | 9,4 | 14,4 | 19,4 | 24,4 | 29,4 | 34,4 | 39,4 |
| 9 | 4,9 | 9,9 | 14,9 | 19,9 | 24,9 | 29,9 | 34,9 | 39,9 |
| 14 | 4,14 | 9,14 | 14,14 | 19,14 | 24,14 | 29,14 | 34,14 | 39,14 |
| 19 | 4,19 | 9,19 | 14,19 | 19,19 | 24,19 | 29,19 | 34,19 | 39,19 |
| 24 | 4,24 | 9,24 | 14,24 | 19,24 | 24,24 | 29,24 | 34,24 | 39,24 |
| 29 | 4,29 | 9,29 | 14,29 | 19,29 | 24,29 | 29,29 | 34,29 | 39,29 |
| 34 | 4,34 | 9,34 | 14,34 | 19,34 | 24,34 | 29,34 | 34,34 | 39,34 |
| 39 | 4,39 | 9,39 | 14,39 | 19,39 | 24,39 | 29,39 | 34,39 | 39,39 |

rr [4][4]

FIG. 5e

| | 0 | 5 | 10 | 15 | 20 | 25 | 30 | 35 |
|---|---|---|---|---|---|---|---|---|
| 1 | 0,1 | 5,1 | 10,1 | 15,1 | 20,1 | 25,1 | 30,1 | 35,1 |
| 6 | 0,6 | 5,6 | 10,6 | 15,6 | 20,6 | 25,6 | 30,6 | 35,6 |
| 11 | 0,11 | 5,11 | 10,11 | 15,11 | 20,11 | 25,11 | 30,11 | 35,11 |
| 16 | 0,16 | 5,16 | 10,16 | 15,16 | 20,16 | 25,16 | 30,16 | 35,16 |
| 21 | 0,21 | 5,21 | 10,21 | 15,21 | 20,21 | 25,21 | 30,21 | 35,21 |
| 26 | 0,26 | 5,26 | 10,26 | 15,26 | 20,26 | 25,26 | 30,26 | 35,26 |
| 31 | 0,31 | 5,31 | 10,31 | 15,31 | 20,31 | 25,31 | 30,31 | 35,31 |
| 36 | 0,36 | 5,36 | 10,36 | 15,36 | 20,36 | 25,36 | 30,36 | 35,36 |

500 rr [0][1]

FIG. 5f

| | 0 | 5 | 10 | 15 | 20 | 25 | 30 | 35 |
|---|---|---|---|---|---|---|---|---|
| 2 | 0,2 | 5,2 | 10,2 | 15,2 | 20,2 | 25,2 | 30,2 | 35,2 |
| 7 | 0,7 | 5,7 | 10,7 | 15,7 | 20,7 | 25,7 | 30,7 | 35,7 |
| 12 | 0,12 | 5,12 | 10,12 | 15,12 | 20,12 | 25,12 | 30,12 | 35,12 |
| 17 | 0,17 | 5,17 | 10,17 | 15,17 | 20,17 | 25,17 | 30,17 | 35,17 |
| 22 | 0,22 | 5,22 | 10,22 | 15,22 | 20,22 | 25,22 | 30,22 | 35,22 |
| 27 | 0,27 | 5,27 | 10,27 | 15,27 | 20,27 | 25,27 | 30,27 | 35,27 |
| 32 | 0,32 | 5,32 | 10,32 | 15,32 | 20,32 | 25,32 | 30,32 | 35,32 |
| 37 | 0,37 | 5,37 | 10,37 | 15,37 | 20,37 | 25,37 | 30,37 | 35,37 |

500 rr[0][2]

FIG. 5g

| | 0 | 5 | 10 | 15 | 20 | 25 | 30 | 35 |
|---|---|---|---|---|---|---|---|---|
| 3 | 0,3 | 5,3 | 10,3 | 15,3 | 20,3 | 25,3 | 30,3 | 35,3 |
| 8 | 0,8 | 5,8 | 10,8 | 15,8 | 20,8 | 25,8 | 30,8 | 35,8 |
| 13 | 0,13 | 5,13 | 10,13 | 15,13 | 20,13 | 25,13 | 30,13 | 35,13 |
| 18 | 0,18 | 5,18 | 10,18 | 15,18 | 20,18 | 25,18 | 30,18 | 35,18 |
| 23 | 0,23 | 5,23 | 10,23 | 15,23 | 20,23 | 25,23 | 30,23 | 35,23 |
| 28 | 0,28 | 5,28 | 10,28 | 15,28 | 20,28 | 25,28 | 30,28 | 35,28 |
| 33 | 0,33 | 5,33 | 10,33 | 15,33 | 20,33 | 25,33 | 30,33 | 35,33 |
| 38 | 0,38 | 5,38 | 10,38 | 15,38 | 20,38 | 25,38 | 30,38 | 35,38 |

500 rr[0][3]

FIG. 5h

| | 0 | 5 | 10 | 15 | 20 | 25 | 30 | 35 |
|---|---|---|---|---|---|---|---|---|
| 4 | 0,4 | 5,4 | 10,4 | 15,4 | 20,4 | 25,4 | 30,4 | 35,4 |
| 9 | 0,9 | 5,9 | 10,9 | 15,9 | 20,9 | 25,9 | 30,9 | 35,9 |
| 14 | 0,14 | 5,14 | 10,14 | 15,14 | 20,14 | 25,14 | 30,14 | 35,14 |
| 19 | 0,19 | 5,19 | 10,19 | 15,19 | 20,19 | 25,19 | 30,19 | 35,19 |
| 24 | 0,24 | 5,24 | 10,24 | 15,24 | 20,24 | 25,24 | 30,24 | 35,24 |
| 29 | 0,29 | 5,29 | 10,29 | 15,29 | 20,29 | 25,29 | 30,29 | 35,29 |
| 34 | 0,34 | 5,34 | 10,34 | 15,34 | 20,34 | 25,34 | 30,34 | 35,34 |
| 39 | 0,39 | 5,39 | 10,39 | 15,39 | 20,39 | 25,39 | 30,39 | 35,39 |

500 rr[0][4]

FIG. 5i

| | 1 | 6 | 11 | 16 | 21 | 26 | 31 | 36 |
|---|---|---|---|---|---|---|---|---|
| 2 | 1,2 | 6,2 | 11,2 | 16,2 | 21,2 | 26,2 | 31,2 | 36,2 |
| 7 | 1,7 | 6,7 | 11,7 | 16,7 | 21,7 | 26,7 | 31,7 | 36,7 |
| 12 | 1,12 | 6,12 | 11,12 | 16,12 | 21,12 | 26,12 | 31,12 | 36,12 |
| 17 | 1,17 | 6,17 | 11,17 | 16,17 | 21,17 | 26,17 | 31,17 | 36,17 |
| 22 | 1,22 | 6,22 | 11,22 | 16,22 | 21,22 | 26,22 | 31,22 | 36,22 |
| 27 | 1,27 | 6,27 | 11,27 | 16,27 | 21,27 | 26,27 | 31,27 | 36,27 |
| 32 | 1,32 | 6,32 | 11,32 | 16,32 | 21,32 | 26,32 | 31,32 | 36,32 |
| 37 | 1,37 | 6,37 | 11,37 | 16,37 | 21,37 | 26,37 | 31,37 | 36,37 |

500 rr [1][2]

FIG. 5j

| | 1 | 6 | 11 | 16 | 21 | 26 | 31 | 36 |
|---|---|---|---|---|---|---|---|---|
| 3 | 1,3 | 6,3 | 11,3 | 16,3 | 21,3 | 26,3 | 31,3 | 36,3 |
| 8 | 1,8 | 6,8 | 11,8 | 16,8 | 21,8 | 26,8 | 31,8 | 36,8 |
| 13 | 1,13 | 6,13 | 11,13 | 16,13 | 21,13 | 26,13 | 31,13 | 36,13 |
| 18 | 1,18 | 6,18 | 11,18 | 16,18 | 21,18 | 26,18 | 31,18 | 36,18 |
| 23 | 1,23 | 6,23 | 11,23 | 16,23 | 21,23 | 26,23 | 31,23 | 36,23 |
| 28 | 1,28 | 6,28 | 11,28 | 16,28 | 21,28 | 26,28 | 31,28 | 36,28 |
| 33 | 1,33 | 6,33 | 11,33 | 16,33 | 21,33 | 26,33 | 31,33 | 36,33 |
| 38 | 1,38 | 6,38 | 11,38 | 16,38 | 21,38 | 26,38 | 31,38 | 36,38 |

500 rr[1][3]

FIG. 5k

| | 1 | 6 | 11 | 16 | 21 | 26 | 31 | 36 |
|---|---|---|---|---|---|---|---|---|
| 4 | 1,4 | 6,4 | 11,4 | 16,4 | 21,4 | 26,4 | 31,4 | 36,4 |
| 9 | 1,9 | 6,9 | 11,9 | 16,9 | 21,9 | 26,9 | 31,9 | 36,9 |
| 14 | 1,14 | 6,14 | 11,14 | 16,14 | 21,14 | 26,14 | 31,14 | 36,14 |
| 19 | 1,19 | 6,19 | 11,19 | 16,19 | 21,19 | 26,19 | 31,19 | 36,19 |
| 24 | 1,24 | 6,24 | 11,24 | 16,24 | 21,24 | 26,24 | 31,24 | 36,24 |
| 29 | 1,29 | 6,29 | 11,29 | 16,29 | 21,29 | 26,29 | 31,29 | 36,29 |
| 34 | 1,34 | 6,34 | 11,34 | 16,34 | 21,34 | 26,34 | 31,34 | 36,34 |
| 39 | 1,39 | 6,39 | 11,39 | 16,39 | 21,39 | 26,39 | 31,39 | 36,39 |

500 rr[1][4]

FIG. 5 l

| | 2 | 7 | 12 | 17 | 22 | 27 | 32 | 37 |
|---|---|---|---|---|---|---|---|---|
| 3 | 2,3 | 7,3 | 12,3 | 17,3 | 22,3 | 27,3 | 32,3 | 37,3 |
| 8 | 2,8 | 7,8 | 12,8 | 17,8 | 22,8 | 27,8 | 32,8 | 37,8 |
| 13 | 2,13 | 7,13 | 12,13 | 17,13 | 22,13 | 27,13 | 32,13 | 37,13 |
| 18 | 2,18 | 7,18 | 12,18 | 17,18 | 22,18 | 27,18 | 32,18 | 37,18 |
| 23 | 2,23 | 7,23 | 12,23 | 17,23 | 22,23 | 27,23 | 32,23 | 37,23 |
| 28 | 2,28 | 7,28 | 12,28 | 17,28 | 22,28 | 27,28 | 32,28 | 37,28 |
| 33 | 2,33 | 7,33 | 12,33 | 17,33 | 22,33 | 27,33 | 32,33 | 37,33 |
| 38 | 2,38 | 7,38 | 12,38 | 17,38 | 22,38 | 27,38 | 32,38 | 37,38 |

500 rr[2][3]

FIG. 5m

| | 2 | 7 | 12 | 17 | 22 | 27 | 32 | 37 |
|---|---|---|---|---|---|---|---|---|
| 4 | 2,4 | 7,4 | 12,4 | 17,4 | 22,4 | 27,4 | 32,4 | 37,4 |
| 9 | 2,9 | 7,9 | 12,9 | 17,9 | 22,9 | 27,9 | 32,9 | 37,9 |
| 14 | 2,14 | 7,14 | 12,14 | 17,14 | 22,14 | 27,14 | 32,14 | 37,14 |
| 19 | 2,19 | 7,19 | 12,19 | 17,19 | 22,19 | 27,19 | 32,19 | 37,19 |
| 24 | 2,24 | 7,24 | 12,24 | 17,24 | 22,24 | 27,24 | 32,24 | 37,24 |
| 29 | 2,29 | 7,29 | 12,29 | 17,29 | 22,29 | 27,29 | 32,29 | 37,29 |
| 34 | 2,34 | 7,34 | 12,34 | 17,34 | 22,34 | 27,34 | 32,34 | 37,34 |
| 39 | 2,39 | 7,39 | 12,39 | 17,39 | 22,39 | 27,39 | 32,39 | 37,39 |

500 rr[2][4]

FIG. 5n

| | 3 | 8 | 13 | 18 | 23 | 28 | 33 | 38 |
|---|---|---|---|---|---|---|---|---|
| 4 | 3,4 | 8,4 | 13,4 | 18,4 | 23,4 | 28,4 | 33,4 | 38,4 |
| 9 | 3,9 | 8,9 | 13,9 | 18,9 | 23,9 | 28,9 | 33,9 | 38,9 |
| 14 | 3,14 | 8,14 | 13,14 | 18,14 | 23,14 | 28,14 | 33,14 | 38,14 |
| 19 | 3,19 | 8,19 | 13,19 | 18,19 | 23,19 | 28,19 | 33,19 | 38,19 |
| 24 | 3,24 | 8,24 | 13,24 | 18,24 | 23,24 | 28,24 | 33,24 | 38,24 |
| 29 | 3,29 | 8,29 | 13,29 | 18,29 | 23,29 | 28,29 | 33,29 | 38,29 |
| 34 | 3,34 | 8,34 | 13,34 | 18,34 | 23,34 | 28,34 | 33,34 | 38,34 |
| 39 | 3,39 | 8,39 | 13,39 | 18,39 | 23,39 | 28,39 | 33,39 | 38,39 |

500 rr[3][4]

FIG. 5o

| | | | | | | | |
|---|---|---|---|---|---|---|---|
| 0 | 1 | 2 | 3 | 4 | 5 | 6 | 7 |
| 8 | 9 | 10 | 11 | 12 | 13 | 14 | 15 |
| 16 | 17 | 18 | 19 | 20 | 21 | 22 | 23 |
| 24 | 25 | 26 | 27 | 28 | 29 | 30 | 31 |
| 32 | 33 | 34 | 35 | 36 | 37 | 38 | 39 |
| 40 | 41 | 42 | 43 | 44 | 45 | 46 | 47 |
| 48 | 49 | 50 | 51 | 52 | 53 | 54 | 55 |
| 56 | 57 | 58 | 59 | 60 | 61 | 62 | 63 |

FIG. 7

| | | | | |
|---|---|---|---|---|
| &rr[4][4]+63 | &rr[3][4]+63 | &rr[2][4]+63 | &rr[1][4]+63 | &rr[0][4]+63 |
| &rr[3][3]+63 | &rr[2][3]+63 | &rr[1][3]+63 | &rr[0][3]+63 | &rr[3][4]+62 |
| &rr[2][2]+63 | &rr[1][2]+63 | &rr[0][2]+63 | &rr[2][4]+62 | &rr[2][3]+62 |
| &rr[1][1]+63 | &rr[0][1]+63 | &rr[1][4]+62 | &rr[1][3]+62 | &rr[1][2]+62 |
| &rr[0][0]+63 | &rr[0][4]+62 | &rr[0][3]+62 | &rr[0][2]+62 | &rr[0][1]+62 |

M1

FIG. 8a

| | | | | |
|---|---|---|---|---|
| 8 | 8 | 8 | 8 | 8 |
| 8 | 8 | 8 | 8 | 1 |
| 8 | 8 | 8 | 1 | 1 |
| 8 | 8 | 1 | 1 | 1 |
| 8 | 1 | 1 | 1 | 1 |

M2

FIG. 8b

| | | | | |
|---|---|---|---|---|
| &rr[0][0] | &rr[0][1] | &rr[0][2] | &rr[0][3] | &rr[0][4] |
| &rr[0][1] | &rr[1][1] | &rr[1][2] | &rr[1][3] | &rr[1][4] |
| &rr[0][2] | &rr[1][2] | &rr[2][2] | &rr[2][3] | &rr[2][4] |
| &rr[0][3] | &rr[1][3] | &rr[2][3] | &rr[3][3] | &rr[3][4] |
| &rr[0][4] | &rr[1][4] | &rr[2][4] | &rr[3][4] | &rr[4][4] |

M3

FIG. 9a

| | | | | |
|---|---|---|---|---|
| 0 | 0 | 0 | 0 | 0 |
| 1 | 0 | 0 | 0 | 0 |
| 1 | 1 | 0 | 0 | 0 |
| 1 | 1 | 1 | 0 | 0 |
| 1 | 1 | 1 | 1 | 0 |

M4

FIG. 9b

960

| | | | | | | | |
|---|---|---|---|---|---|---|---|
| 0 | 1 | 2 | 3 | 4 | 5 | 6 | 7 |
| 8 | 9 | 10 | 11 | 12 | 13 | 14 | 15 |
| 16 | 17 | 18 | 19 | 20 | 21 | 22 | 23 |
| 24 | 25 | 26 | 27 | 28 | 29 | 30 | 31 |
| 32 | 33 | 34 | 35 | 36 | 37 | 38 | 39 |
| 40 | 41 | 42 | 43 | 44 | 45 | 46 | 47 |
| 48 | 49 | 50 | 51 | 52 | 53 | 54 | 55 |
| 56 | 57 | 58 | 59 | 60 | 61 | 62 | 63 |

950

FIG. 10

ACLEP CODEC WITH MODIFIED AUTOCORRELATION MATRIX STORAGE AND SEARCH

FIELD OF THE INVENTION

This invention relates generally to code excited linear predictive (CELP) speech coders in wireless communications systems, and more specifically to a means for reducing memory usage and enhancing searchability for implementing an algebraic code excited linear predictive (ACELP) codec in wireless communications systems.

BACKGROUND OF THE INVENTION

An important aspect in wireless communications and cellular mobile radio is spectral efficiency, i.e., the user density of the allocated spectrum. Several factors play a role in determining the system's spectral efficiency, including cell size, method of multiple access, and modulation technique. As speech transmissions represent the most-used form of communications, the bit rate of the speech codec plays a significant role in determining the system's spectral efficiency. Therefore, the need for a low bit rate speech codec is of great importance, particularly when considering future generations of personal communications systems (PCS).

Selection of a speech codec for PCS is not a trivial task since most existing low bit rate speech coders are highly complex, requiring computational capabilities in mobile stations that can present a significant drain on power. Advances in speech coding algorithmic implementations and low-power integrated circuits have provided some improvement at the cost of speech quality, however, issues of performance remain where there is a lot of background noise, such as noise from a car, a crowd or nonspeech sounds, such as music. With the increased usage of wireless communications systems, the demands of wireless subscribers for speech quality that is comparable to that of land-based networks have similarly increased. In addition, the speech coders must be robust, able to withstand high bit-error rates and burst errors without causing instabilities and subjecting the user to annoying effects. In radio channels, occasional long error bursts during deep fades are produced, resulting in correlated speech frame erasures. The codec should be able to estimate the lost speech frames with minimal loss in speech quality. This is particularly important in PCS systems, were the percentage of frame erasures is a measured system parameter. The ability of the codec to tolerate higher frame erasure rates has a significant impact on the efficiency of such systems.

Code excited linear predictive (CELP) coding has been extensively investigated as a promising algorithm to provide good quality at low bit rates. CELP coding is based on vector quantization and the fact that positions on the spectral "grid" of speech are redundant. The most likely positions on the grid are represented by a vector, and all of the vectors are stored in a codebook at both the analyzer and synthesizer. In accordance with this method, the speech signal is sampled and converted into successive blocks of a predetermined number of samples. Each block of samples is synthesized by filtering an appropriate innovation sequence from the codebook, scaled by a gain factor, through two filters having transfer functions varying in time. The first filter is a Long Term Predictor filter (LTP), or pitch filter, for modeling the pseudo-periodicity of speech due to pitch. The second filter is a Short Term Predictor filter (STP), which models the spectral characteristics of the speech signal. The encoding procedure used to determine the pitch and excitation codebook parameters is an Analysis-by-Synthesis (AbS) technique. AbS codecs work by splitting the speech to be coded into frames, typically about 20 msec. long. For each frame, parameters are determined for a synthesis filter, then the excitation for this filter is determined. This is done by finding the excitation signal which, when passed into the given synthesis filter, minimizes the error between the input speech and the reconstructed speech. The synthetic output is computed for all candidate innovation sequences from the codebook. The retained codeword is the one corresponding to the synthetic output which has the lowest error relative to the original speech signal according to a perceptually weighted distortion measure. This codeword is then transmitted to the receiver with the speech signal, along with a gain term.

Typically, the CELP codebook searches are computationally intensive and require a significant amount of memory storage capacity. This problem is particularly troublesome in wideband applications where larger frame sizes and, thus, larger codebooks, are needed.

There are a number of variations on CELP techniques, each providing different algorithms for establishing a predefined structure which is directed toward reducing the number of computations required for the codebook search process. One such CELP method, Algebraic CELP (ACELP) uses a sparse algebraic code and a focused search approach in order to reduce the number of computational steps. This technique is described by J-P. Adoul and C. LaFlamme in U.S. Pat. No. 5,444,816 and is further detailed in an article co-authored by the same inventors entitled "A Toll Quality 8Kb/s Speech Codec for the Personal Communications System (PCS)", *IEEE Trans. On Veh. Tech.*, Vol. 43, No. 3, August 1994, p. 808–816. Both disclosures are incorporated herein by reference.

Variations of ACELP codecs of the type Enhanced Full Rate (EFR)-ACELP, have been adopted for use in PCS and GSM networks. One such codec is described in ANSI J-STD 007 Air Interface Volume 3, "Enhanced Full Rate Codec". Another ACELP codec is described in Telecommunications Industry Association/Electronics Industries Association Interim Standard 641 (TIA/EIA/IS-641), "TDMA Cellular/PCS—Radio Interface—Enhanced Full-Rate Speech Codec". A low-level description of the PCS-1900 enhanced GSM full-rate ACELP (EFR-ACELP) operating at 13 kb/s is provided in a Draft Recommendation dated April 1995 (Version 1.1), which has been distributed to the industry for comment and voting. Both standards and the Draft Recommendation are incorporated herein by reference.

In the EFR-ACELP codec, the codebook is in the form of matrices containing the correlation coefficients, i.e., the indices of codewords, for synthesizing the speech vectors to obtain the excitation. The size of the matrix is determined by the length of the vectors stored therein. In the wideband applications of PCS, the weighted synthesis filter impulse response and the sample sign are each length 40 vectors, which results in an autocorrelation matrix which is 40×40. The correlation coefficients are computed recursively starting at the lower right corner of the matrix (39,39) and along the diagonals. This matrix, which is symmetrical along its main diagonal, represents one of the largest dynamic variables in EFR-ACELP codec implementation. While the matrix enables simple access to individual elements, it uses a significant amount of memory (1600 words) in devices where memory space on the digital signal processor (DSP) is limited. Alternative storage schemes, such as storing one-half of the matrix, would require complex addressing schemes to access individual elements of the matrix.

Accordingly, a need remains for effective implementation of EFR-ACELP for a means for retaining the advantageous search capabilities of established ACELP techniques while reducing demands on the storage capacity of the DSP which is performing the encoding/decoding. The invention described herein addresses this need.

SUMMARY OF THE INVENTION

It is an advantage of the present invention to provide a means for implementing EFR-ACELP speech coding in PCS and enhanced GSM wireless systems while preserving memory space in the DSP.

In an exemplary embodiment, a codec is implemented in a DSP with a local memory. The codec structure comprises a short-term linear prediction (LP) synthesis filter which receives an excitation signal which is constructed by adding two excitation vectors from an adaptive codebook and a fixed codebook. The optimum excitation sequence in a codebook is selected using the algebraic codebook search algorithm in EFR-ACELP and an Analysis-by-Synthesis search procedure in which the error between the original and synthesized speech is minimized according to a perceptually weighted distortion measure. A codebook correlation matrix comprises a Toeplitz-type (diagonally symmetric) matrix which is an autocorrelation of forty sample weighted impulse response vectors with sign vector incorporated, forming a 40×40 matrix. The correlation coefficients which constitute the codes are stored within the DSP's local memory after calculation by dividing a matrix into five pre-defined x- and y- tracks, each track having eight positions. The five x- and y- tracks each have the same number assignments, e.g., Track 0 includes samples 0, 5, 10, 15, 20, 25, 30, and 35, regardless of whether the samples are weighted impulse response or sign vectors. Using the eight positions on each track, fifteen 8×8 sub-matrices are created which include all of the correlation coefficients in the original 40×40 matrix. This is achieved by storing one sub-matrix for each combination of track numbers without regard for whether the track number is for an x- or y- track. For example, if two possible sub-matrices are rr[1][0] and rr[0][1], only one of these matrices is stored since one is merely the transposition of the other. Using this storage scheme, volume-wise, all of the sub-matrices combined include slightly more than one-half of the contents of the original matrix. The sub-matrices are used to form 5×5 mapping matrices, which are stored and searched in sequences that cause them to correspond to diagonals of the original 40×40 matrix. The sub-matrices within the mapping matrices are accessed for storage and searching by directing a multiplex switch, or pointer, to the appropriate column or row of the mapping matrix. The order in which values are stored in the sub-matrices is not critical as long as each is a 64 word space (8×8 matrix), and the starting address of each sub-matrix is known.

Generally, the alternative storage and searching procedure may be used to substitute a plurality of sub-matrices for a larger Toeplitz-type correlation matrix to reduce the storage requirements without compromising the advantages of a relatively simple addressing scheme. For example, the larger Toeplitz-type correlation matrix has a size N×N. The number of sub-matrices is determined by the number of tracks T which may be defined within the N×N matrix, with the tracks being defined as equal-sizes sub-sets of N, each of which include a unique set of elements of the N×N matrix. Dividing the sub-matrices into columns and providing a multiplex switch for selecting the different columns, the coefficients contained in the sub-matrices may be completely searched without requiring storage of the entire N×N matrix.

BRIEF DESCRIPTION OF THE DRAWINGS

Understanding of the present invention will be facilitated by consideration of the following detailed description of preferred embodiments of the present invention taken in conjunction with the accompanying drawings, in which like numerals refer to like parts, and in which:

FIGS. 5*a*–5*o* are diagrams of each of the fifteen 8×8 sub-matrices rr[0][0], rr[1,][1], rr[2][2], rr[3][3], rr[0][1], rr[0][2], rr[0][3], rr[0][4], rr[1][2], rr[1][3], rr[1][4], rr[2][3], rr[2][4] and rr[3][4], respectively;

FIG. 7 is a diagram of an 8×8 matrix showing elements 0 through 63;

FIGS. 8*a* and 8*b* are diagrams of exemplary mapping matrices M1 and M2 for storage of the correlation coefficients;

FIGS. 9*a* and 9*b* are diagrams of exemplary mapping matrices M3 and M4 for searching of the correlation coefficients; and FIG. 10 is a diagram of an 8×8 correlation sub-matrix.

DETAILED DESCRIPTION OF A PREFERRED EMBODIMENT

The following detailed description utilizes a number of acronyms which are generally well known in the art. While definitions are typically provided with the first instance of each acronym, for convenience, Table 1 below provides a list of the acronyms and abbreviations used herein along with their respective definitions.

TABLE 1

| ACRONYM | DEFINITION |
|---|---|
| AbS | Analysis-by-Synthesis |
| ACELP | Algebraic Codebook Excited Linear Prediction |
| ANSI | American National Standards Institute |
| CELP | Codebook Excited Linear Prediction |
| DSP | Digital Signal Processor |
| EFR | Enhanced Full Rate |
| EIA | Electronics Industries Association |
| GSM | Global System for Mobile Communication |
| LP | Linear Prediction |
| LSP | Line Spectrum Pair |
| PCS | Personal Communication System |
| SMQ | Split Matrix Quantization |
| TIA | Telecommunications Industry Association |

Figure 1:
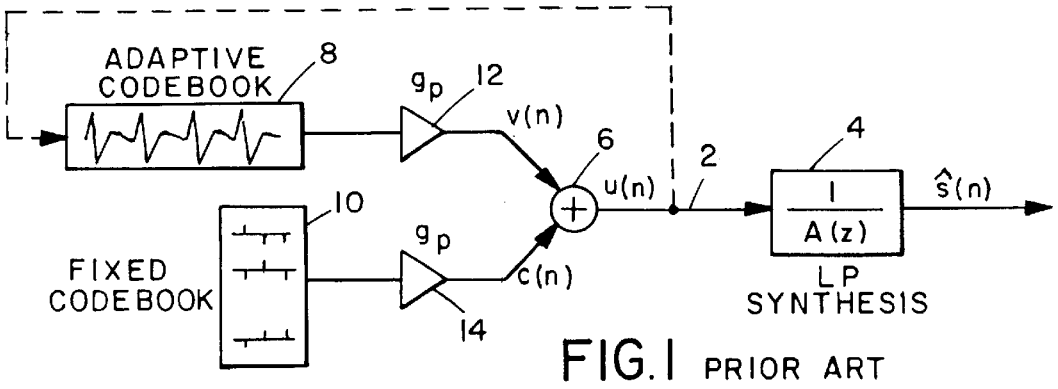
FIG. 1 PRIOR ART
FIG. 1 is a block diagram of a CELP synthesis model.

FIG. 1 provides a basic block diagram of a prior art CELP synthesis model. In this model, the excitation signal 2 at the input of the short-term LP synthesis filter 4 is constructed by summing at summer 6 two excitation vectors from an adaptive codebook 8 and a fixed codebook 10. The signals generated from the two codebooks are amplified at amplifiers 12 and 14 by gain factors $g_p$ and $g_c$ for pitch and code, respectively.

Figure 2:
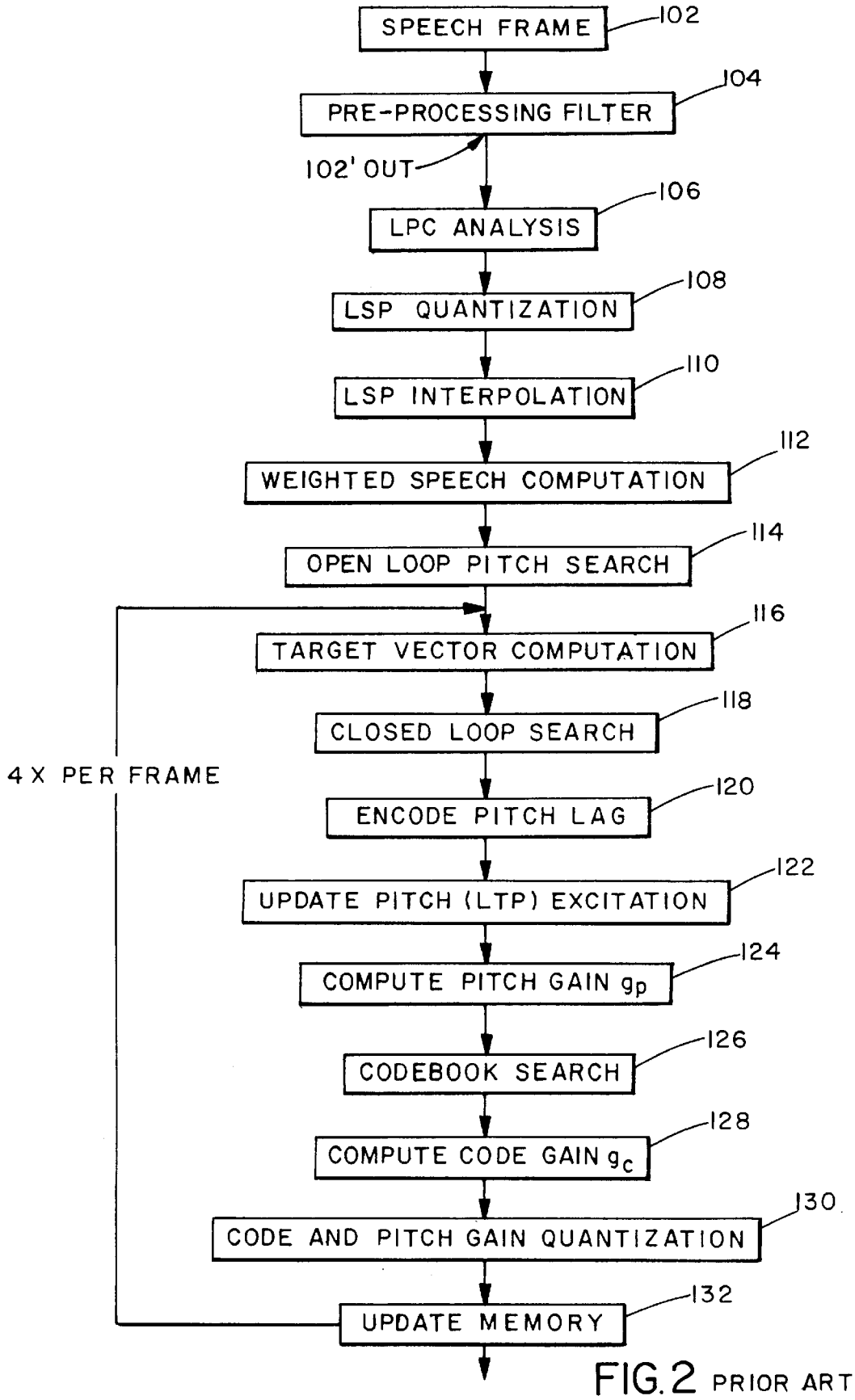
FIG. 2 PRIOR ART
FIG. 2 is a flow diagram of the signal flow at the encoder according to the standardized PCS EFR-ACELP codec.

The signal flow for a prior art EFR-ACELP encoder according to the PCS-1900 EFR-ACELP codec standards is illustrated in FIG. 2. A number of speech frames 102 are obtained from an uncompressed signal from an analog-to-digital converter in a PCS system transmitter (not shown) and provided to a DSP. Each speech frame 102 is 20 msec corresponding to 160 samples at the sampling frequency of 8000 samples per second. The speech frame 102 is passed through preprocessing filter 104 which provides high-pass filtering and signal down-scaling, producing filtered speech frame 102'. For each frame 102', linear prediction (LP) analysis is performed twice per frame using two different 30 msec. asymmetric windows. Applied to the windows are 80 samples from a past speech frame in addition to the now-filtered 160 samples from the present frame. In LP analysis step 106 autocorrelations are used to obtain the LP coefficients, resulting in two sets of ten coefficients. The LP coefficients are then converted into the LSP representation (in the frequency domain), where the LSPs are defined as the root of symmetric and antisymmetric polynomials, each of which provide five LSP coefficients. Four sets of LSPs are found by evaluating the polynomials. In LSP quantization step 108, two sets of the LSPs are quantized using split matrix quantization (SMQ), leaving the other two sets unquantized. The speech frame is divided into four sub-frames of 5 msec (40 samples). The adaptive and fixed codebook parameters are transmitted every subframe. In interpolation step 110, the two sets of quantized and unquantized LP filters are used for the second and fourth subframes, while in the first and third subframes, interpolated LP filters are used (both quantized and unquantized.) The frame 102' of the input speech signal is filtered through a weighting filter to produce a perceptually weighted speech signal (step 112). In step 114, an open loop pitch lag is estimated twice per frame (every 10 msec) based on the perceptually weighted speech signal.

The following operations (steps 116–132) are repeated for each of the four subframes: In step 116, the target signal x(n) is computed by filtering the LP residual through the weighted synthesis filter W(z)H(z) with the initial states of the filters having been updated by filtering the error between LP residual and excitation. (This is equivalent to subtracting the zero-input responses of the weighted synthesis filter from the weighted speech signal.) The impulse response h(n) of the weighted synthesis filter is computed. Closed loop pitch analysis (step 118) is then performed to find the pitch lag and gain, using the target x(n) and impulse response h(n), by searching around the open loop pitch lag. Fractional pitch with ⅙ resolution is used. In step 120, the pitch lag is encoded with 9 bits in the first and third subframes and relatively encoded with 6 bits in the second and fourth subframes. Once the pitch lag is determined, an adaptive codebook vector is computed by interpolating the past excitation signal using two FIR filters. The target signal x(n) is updated by removing the pitch, or adaptive codebook, contribution (filtered adaptive codevector) (step 122). The pitch gain is computed using the filtered adaptive codebook vector (step 124), then a search of the adaptive codebook is conducted (step 126) by minimizing the mean square error between the original and the synthesized speech. The updated target signal, $x_2(n)$, which subtracts the adaptive codebook contribution, is used in the fixed algebraic codebook search to find the optimum innovation. The search minimizes the mean square error between the weighted input speech and the weighted synthesis speech. The algebraic codebook consists of 35 bits structured according to an interleaved single-pulse permutation (ISPP) design. The forty positions in a subframe are divided into five tracks, where each track contains two pulses, as shown in Table 2.

TABLE 2

| TRACK | PULSE | POSITIONS |
|---|---|---|
| 0 | $i_0$, $i_5$ | 0, 5, 10, 15, 20, 25, 30, 35 |
| 1 | $i_1$, $i_6$ | 1, 6, 11, 16, 21, 26, 31, 36 |
| 2 | $i_2$, $i_7$ | 2, 7, 12, 17, 22, 27, 32, 37 |
| 3 | $i_3$, $i_8$ | 3, 8, 13, 18, 23, 28, 33, 38 |
| 4 | $i_4$, $i_9$ | 4, 9, 14, 19, 24, 29, 34, 39 |

Each two pulse positions within one track are encoded with 5 bits (total of 25 bits), and each pulse amplitude is encoded with 1 bit (total of 10 bits), thus making up 35 bits. Each track is a unique subset of the original matrix, representing positions spaced apart at regular intervals of five.

In step 128, the algebraic, or fixed, codebook gain is found using the updated target signal, $x_2(n)$, and the filtered fixed codebook vector. The gains of the adaptive and fixed codebook are vector quantized with 8 bits, with moving-average (MA) prediction applied to the fixed codebook gain (step 130). Finally, in step 132, the synthesis and weighting filters' memories are updated using the determined excitation signal, found using the quantized gains and the respective codebook vectors, to compute the target signal in the next subframe.

Figure 3:
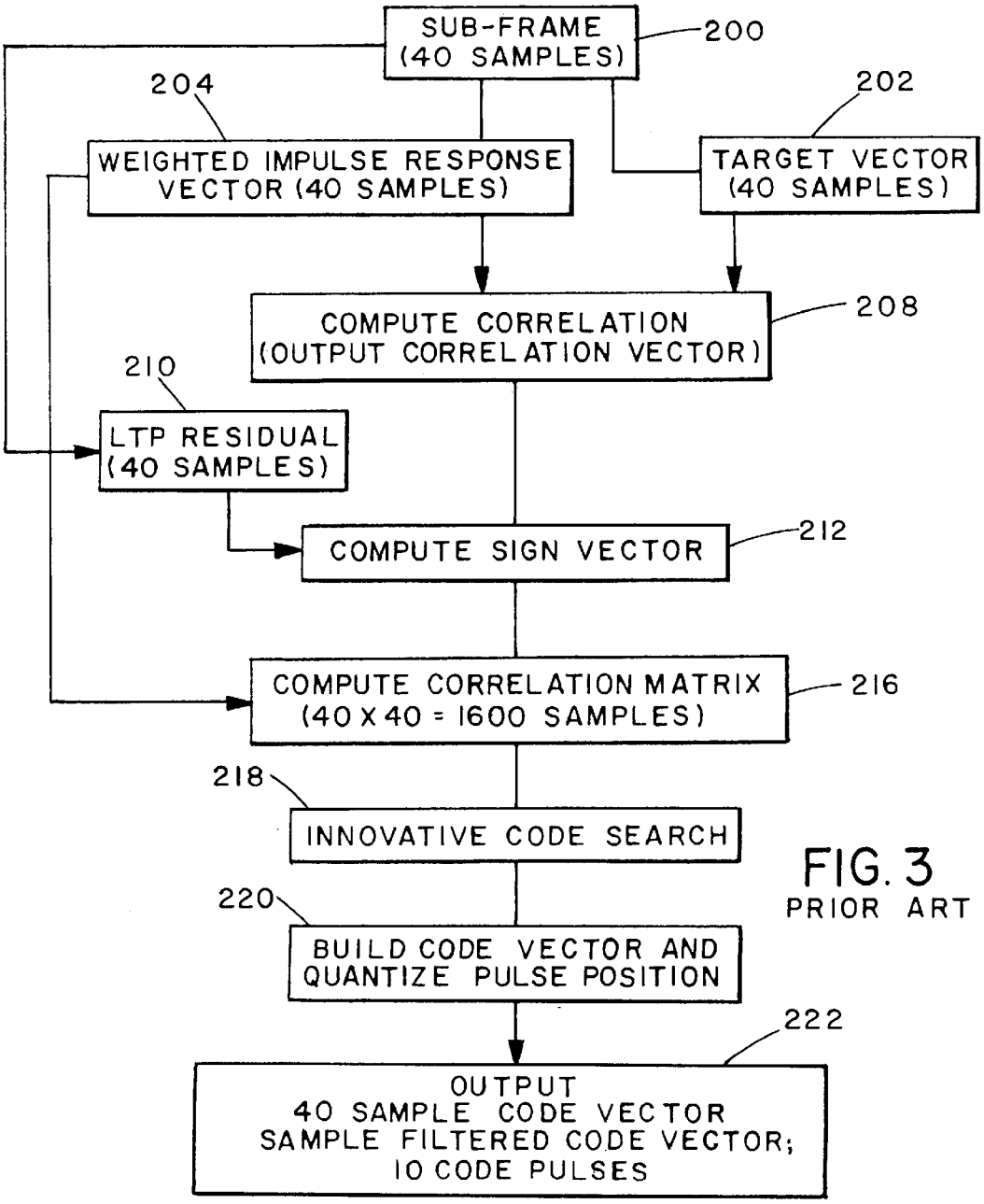
FIG. 3 PRIOR ART
FIG. 3 is a flow diagram of the codebook search sequence according to the standardized PCS EFR-ACELP codec.

FIG. 3 provides a process flow for a codebook search. Inputs consist of forty samples each for target vector 202 and weighted impulse response vector 204, which are obtained from forty sample speech sub-frame 200. In step 206, the correlation, d, between target vector 202 and weighted impulse response vector 204 is computed to produce the correlation vector 208, which has forty samples. The target signal $x_2(n)$ used in this search excludes the adaptive codebook contribution to the signal. The impulse response h(n) is obtained from the weighted synthesis filter used to provide the target signal in step 112. To simplify the search procedure, the pulse amplitudes are preset by the mere quantization of an appropriate signal. In this case, the signal b(n), which is the weighted sum of the normalized target vector, i.e., correlation vector 208, and normalized long term prediction (LTP) residual 210 is used. This is done by setting the amplitude of a pulse at a certain position equal to the sign of b(n) at that position. Thus, in step 212, the correlation vector is modified using the sign information to produce a forty sample sign vector. In step 216, sign vector and weighted impulse response vector 204 are used to compute the correlation matrix.

In step 218, a search of the codebook is performed for a weighted speech target signal (taken at step 112), cross-correlating the target signal and the weighted impulse response signal to provide the innovative code. Using the preset pulse amplitudes, the optimal pulse positions are determined using the AbS search technique. Using the parameters at the identified optimal pulse position, a code-vector is constructed and the pulse position is quantized (step 220). The resulting output 222 is a forty sample codevector, a forty sample filtered codevector, and 10 code pulses.

The preceding description provides the procedure for the standardized PCS-1900 EFR-ACELP codec. The improved codebook storage and search scheme described below utilizes slightly more than one-half of the storage requirements of the original 40×40 matrix, but uses a simpler addressing procedure. A 40×40 autocorrelation matrix, rr[40][40], designated by reference numeral 300, is provided in FIG. 4 to serve as a guideline for demonstrating the correspondence between the prior art storage and search procedure and that of the present invention. The main diagonal 302 is shown, and a grid is provided at intervals of five positions to facilitate tracking of the points.

The five tracks detailed in Table 2 provide the base for the storage and search procedure of the present invention. Using the eight positions on each track, fifteen 8×8 sub-matrices are created based upon the autocorrelation of one track to itself or to another track. The fifteen sub-matrices include all of the correlation coefficients in the original 40×40 matrix. The sub-matrices, designated by their location along the x-(horizontal) and y- (vertical) tracks are shown as FIGS. 5*a*–5*o* as follows:

FIG. 5*a*—rr[0][0]; FIG. 5*b*—rr[1][1]; FIG. 5*c*—*rr*[2][2]; FIG. 5*d*—rr[3][3]; FIG. 5*e*—rr[4][4]; FIG. 5*f*—rr[0][1]; FIG. 5*g*—rr[0][2]; FIG. 5*h*—rr[0][3]; FIG. 5*i*—rr[0][4]; FIG. 5*j*—rr[1][2]; FIG. 5*k*—rr[1][3]; FIG. 5*l*—rr[1][4]; FIG. 5*m*—rr[2][3]; FIG. 5*n*—rr[2][4]; and FIG. 5*o*e—rr[3][4].

Figure 6:
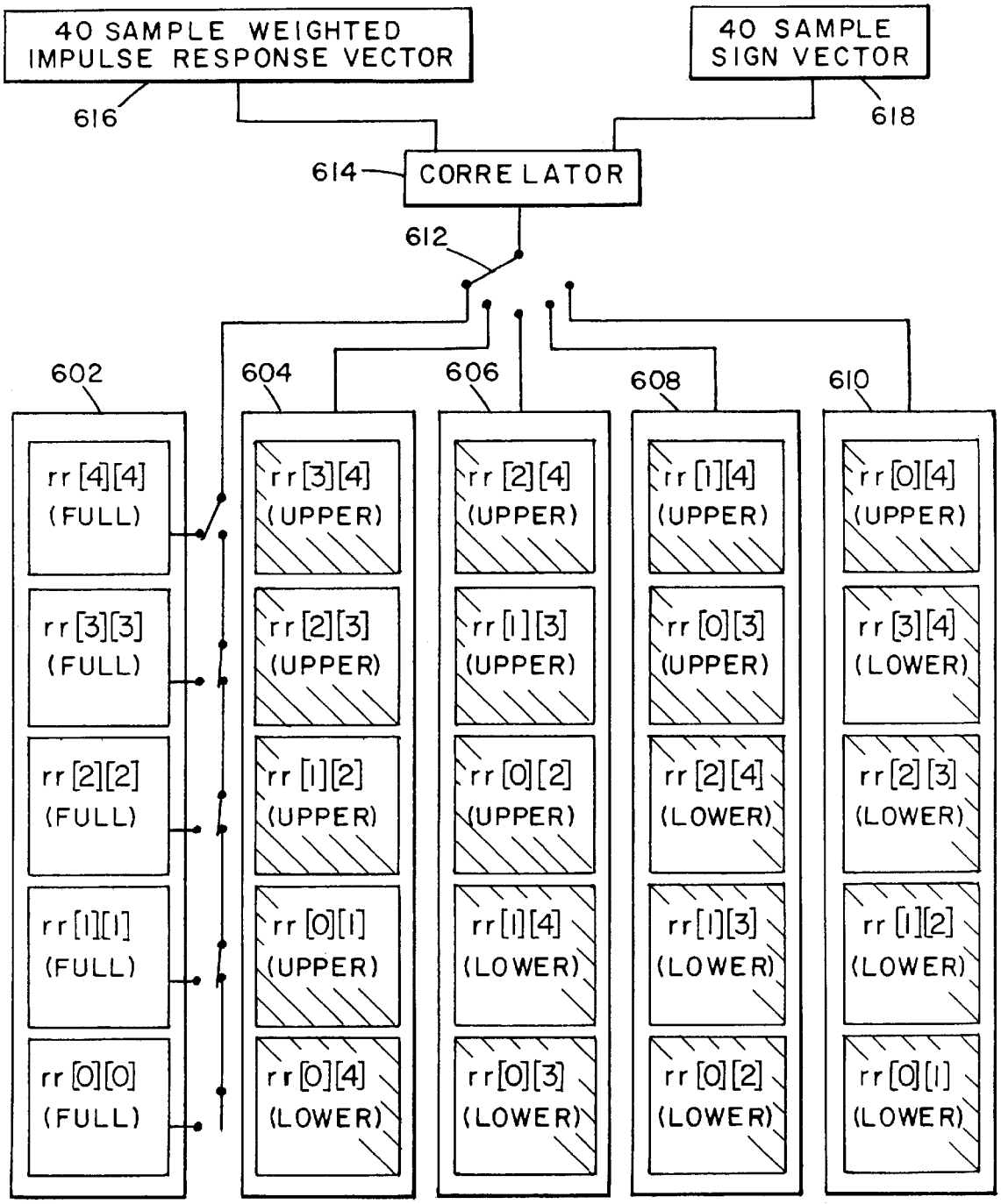
FIG. 6 is a diagram of the computation and storage organization for the sub-matrices.

Volume-wise, all of the sub-matrices combined include slightly more than one-half of the contents of the original matrix, i.e., 960 of the original 1600 coefficients. The sub-matrices are used to form 5×5 mapping matrices, which are stored and searched in sequences that cause them to correspond to diagonals of the original 40×40 matrix. The sub-matrices within the mapping matrices are accessed for storage and searching by directing a multiplex switch, or pointer, to the appropriate column or row of the mapping matrix. The order in which values are stored in the sub-matrices is not critical as long as each sub-matrix is a 64 word space (8×8 matrix), and the starting address of each sub-matrix is known. One possible configuration for storage of the sub-matrices is provided in FIG. 6. The sub-matrices within each column are searched by directing a multiplex switch 612 which connects correlator 614 to a particular column. (Correlator 614 calculates the correlation coefficients using 40 sample input vectors for weighted impulse response 616 and sign 618.) The first column 602 includes sub-matrices rr[4][4], rr[3][3], rr[2][2], rr[1][1], and rr[0][0]. Second column 604 includes the upper portions of sub-matrices rr[3][4], rr[2][3], rr[1][2], rr[0][1], and the lower portion of rr[0][4]. An upper portion of one of the sub-matrices consists of the upper half of the matrix as divided by the main diagonal and includes the main diagonal. The lower portion includes of all points below the main diagonal. In FIG. 6, the non-used portion of a particular sub-matrix in any given column is indicated by dashed diagonal lines. Referring briefly to FIGS. 5*f* through 5*o*, line 500 is indicated in each sub-matrix to illustrate the division between the upper and lower portions. Third column 606 contains the upper portions of sub-matrices rr[2][4], rr[1][3], rr[0][2] and the lower portions of sub-matrices rr[1][4] and rr[0][3]. Fourth column 608 includes the upper portions of sub-matrices rr[1][4], rr[0][3], and the lower portions of rr[2][4], rr[1][3] and rr[0][2]. Fifth column 610 includes the upper portion of sub-matrix rr[0][4] and the lower portions of sub-matrices rr[3][4], rr[2][3], rr[1][2], and rr[0][1]. The partial sub-matrices designated within any given column are selected portions of full sub-matrices such that, as can be seen from FIG. 6, the fifteen sub-matrices are distributed between the five columns and five rows shown. A sub-matrix with an upper portion in one column has a corresponding lower portion in another column. As illustrated in FIG. 6, for example, the upper portion of sub-matrix rr[3][4] is apportioned to second column 604, while its lower portion is located in fifth column 610.

Figure 4:
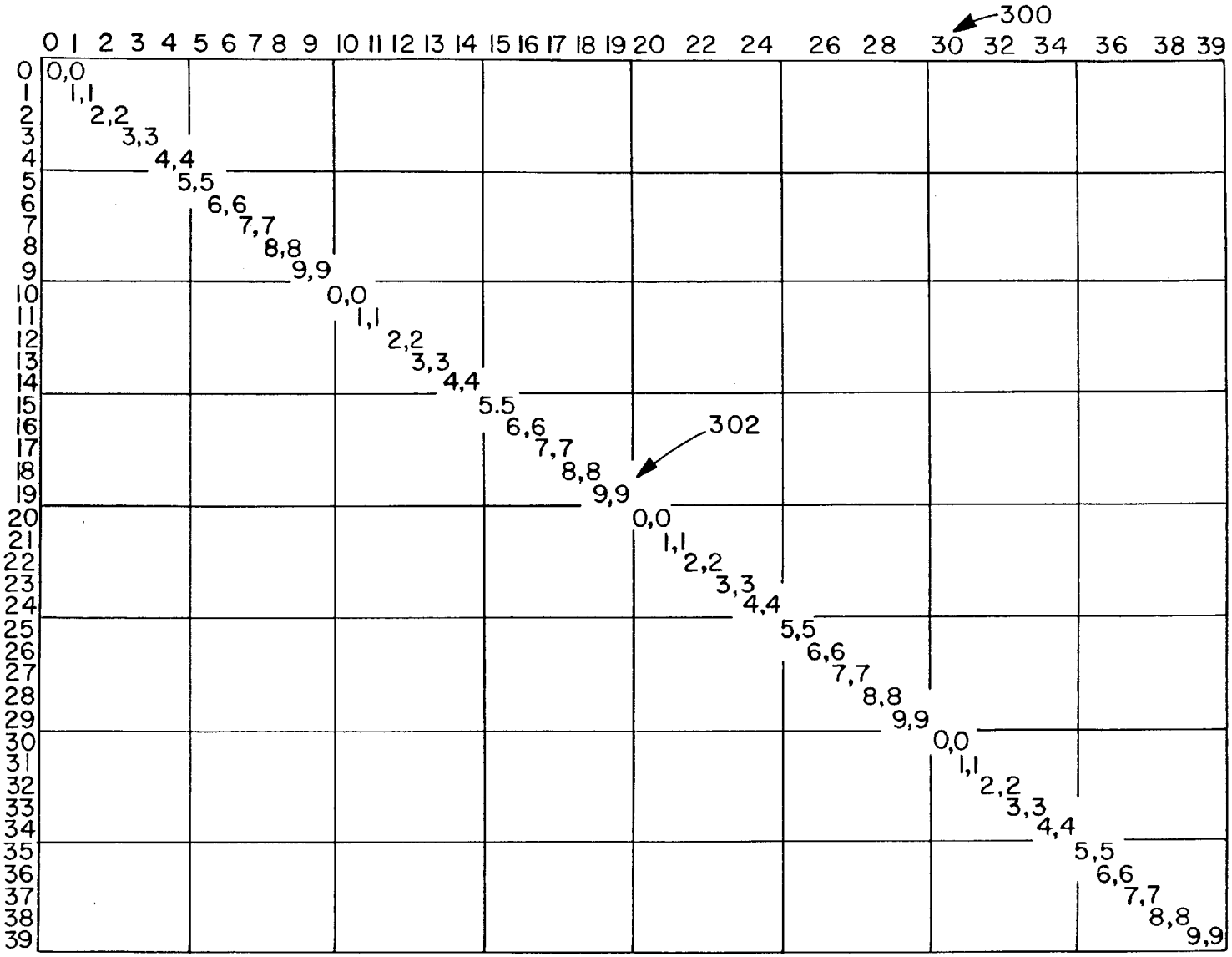
FIG. 4 PRIOR ART
FIG. 4 is a diagram of a 40×40 correlation Toeplitz-type matrix.

In the example of FIG. 6, first column 602 corresponds to the first diagonal that would be computed in a conventional 40×40 matrix storage scheme, which is main diagonal 302 of FIG. 4. (The computation is performed recursively starting from the lower right corner of the matrix, proceeding to the upper left corner, following main diagonal 302.) Thus, the storage process is begins at position [39,39], progressing upward from southeast to northwest, then moving up one diagonal, again proceeding from southeast to northwest.) The order in which the sub-matrix elements are stored also follows the diagonal, beginning with the position at the southeast corner (sub-matrix position [7,7]), but fills sub-matrix position [7,7] for each sub-matrix in the column before shifting up along the diagonal to sub-matrix position [6,6]. Referring to FIG. 5*e*, which shows sub-matrix rr[4][4], the first sub-matrix in first column 602, sub-matrix position [7,7] corresponds to position [39,39] of the original 40×40 matrix. Looking at FIG. 5*d* for sub-matrix rr[3][3], the second sub-matrix in first column 602, sub-matrix position [7,7] is filled with coefficient corresponding to position [38,38] of the original 40×40 matrix. In FIG. 5*c*, position [37,37] is located in sub-matrix position [7,7], and so on. Thus, a reiterative incremental sequence is used, beginning at the top of the column, proceeding to the next lower sub-matrix until reaching the bottom, then returning to the top and beginning again. This sequence may be effected using a mapping function which acts as a second switch to address the next sub-matrix in the sequence. The second switching function is illustrated within first column 602, showing sub-matrix rr[4][4] as being selected. To further extend the example, when first column 602 is selected, the matrix elements are filled in the order shown in Table 3.

TABLE 3

| STEP | SUB-MATRIX | POSITION | POSITION FROM 40X40 |
|---|---|---|---|
| 1 | rr[4][4] [7,7] | | [39,39] |
| 2 | rr[3][3] [7,7] | | [38,38] |
| 3 | rr[2][2] | [7,7] | [37,37] |
| 4 | rr[1][1] | [7,7] | [36,36] |
| 5 | rr[0][0] | [7,7] | [35,35] |
| 6 | rr[4][4] | [6,6] | [34,34] |
| 7 | rr[3][3] | [6,6] | [33,33] |
| 8 | rr[2][2] | [6,6] | [32,32] |
| 9 | rr[1][1] | [6,6] | [31,31] |
| 10 | rr[0][0] | [6,6] | [30,30] |
| 11 | rr[4][4] | [5,5] | [29,29] |
| 12 | rr[3][3] | [5,5] | [28,28] |
| 13 | rr[2][2] | [5,5] | [27,27] |
| 14 | rr[1][1] | [5,5] | [26,26] |
| 15 | rr[0][0] | [5,5] | [25,25] |
| . | . | . | . |
| . | . | . | . |
| . | . | . | . |
| 40 | rr[0][0] | [0,0] | [0,0] |
| . | . | . | . |
| . | . | . | . |
| . | . | . | . |

The mapping function which guides the above sequencing utilizes approximately 100 words of memory. This function is further described below with reference to FIGS. 7 and 8.

Table 3 also provides the corresponding matrix locations for the main diagonal of a 40×40 matrix. After loading of the main diagonal of the 40×40 matrix into the sub-matrices of first column 602 is completed, the next higher diagonal of the sub-matrices will be loaded, i.e., [7,6] to [1,0]. For example, [39,34] is loaded at sub-matrix position [7,6] of sub-matrix rr[4][4], [38,33] is loaded at sub-matrix position [7,6] of sub-matrix rr[3][3], [37,32] is loaded at sub-matrix position [7,6] of sub-matrix rr[2][2], etc. First column 602 includes 320 of the coefficients for the codebook, and the last element to be loaded in this column corresponds to the [35,0] point on the 40×40 matrix.

After the first column 602 is filled, the switch 612 is directed to second column 604 of sub-matrices and the loading continues where it left off after completing first column 602. Because second column 604 includes partial sub-matrices, it contains only 172 coefficients. Following the same procedure for each subsequent column, the third, fourth, and fifth columns are addressed. Third column 606 contains 164 coefficients, fourth column 608 contains 156 coefficients, and fifth column 610 contains 148 coefficients, providing a total of 960 coefficients, i.e., 960 words in memory, compared with the 1600 coefficients for the original 40 ×40 matrix. Taking into account the storage requirements of the mapping function for computation and accessing of the sub-matrices (100 words), there is a savings of 540 words of data memory, which is significant when a typical DSP for codec applications has only 5K to 10K of memory.

The storage procedure of the present invention follows the matrix structure shown in FIG. 7. In this example, as the correlation coefficients are calculated, elements 0 to 63 of an 8×8 sub-matrix refer to locations in the matrix beginning at the top left corner and proceeding left to right and top to bottom. Elements 0 through 63 designate the addresses of the coefficients in a given sub-matrix. The elements of the sub-matrices are organized using the autocorrelation of two 5×5 mapping matrices M1 and M2 which are defined as shown in FIGS. 8*a* and 8*b*. In mapping matrix M1 of FIG. 8*a*, the addresses 62 and 63 are used to indicate the starting point, or first element of the sub-matrix into which a coefficient would be stored. For example, &rr44+63 means that the starting point is the bottom right corner of matrix rr[4][4]. The top left position of mapping matrix M1, i.e., the first column, first row, would include the 64 coefficients that were stored in matrix rr[4][4] because the storage sequence would begin loading at address 63, which corresponds to position [7][7] of the 8×8 matrix, proceed up the main diagonal to [0][0], then go to [7][6] and up the next diagonal and so on, first completing the upper half, then the lower. Where "+62" is designated as the starting address, the storage process starts at address 62, which corresponds to position [6][7] of the 8×8 matrix, then proceeds to cover the lower half of the 8×8 matrix below the main diagonal. FIG. 8*b* provides the structure matrix M2 for determining the structure of the correlation matrix obtained from the correlation of M1 and M2. Comparison of matrix M2 with the structure of FIG. 6 will provide the significance of this matrix, which designates which portion of the sub-matrices are stored in various locations of the correlation matrix, where "8" refers to the upper portion of the 8×8 sub-matrix (as defined with respect to FIG. 6) and "1" refers to the lower portion. Essentially, mapping matrix M2 provides the structure of the correlation matrix, designating which portion of the 8×8 sub-matrices correspond to which location in the correlation matrix. As will be seen below, the storage procedure includes instructs the upper half of the symmetrical sub-matrices (those which have the same track number for x- and y-) to copy to the lower half. Thus, only the upper half need be filled during the computation process.

EXAMPLE

As is known, the computation of the correlation coefficient is described in the EFR-ACELP specification, and is not repeated here. The following pseudo-code sequence provides the procedure for construction of the sub-matrices for the modified storage scheme:

```
Define Variable L1, L2, L3, I1, CC
Define Pointer Variables P0, P1, P2, P3, P4
Set     L1 = 8
        L2 = 0
        L3 = 0
WHILE(1)
        P0 = M1[O][L3]
        P1 = M1[1][L3]
        P2 = M1[2][L3]
        P3 = M1[3][L3]
        P4 = M1[4][L3]
FOR I1 = 1 to L1
        Compute next correlation coefficient CC
        *P0--9 = CC
        Compute next correlation coefficient CC
        *P1--9 = CC
        Compute next correlation coefficient CC
        *P2--9 = CC
        Compute next correlation coefficient CC
        *P3--9 = CC
        Compute next correlation coefficient CC
        *P4--9 = CC
END (FOR)
IF (L2 > 0)
        Compute next correlation coefficient CC
        *P0--9 = CC
END (IF)
IF (L2 > 1)
        Compute next correlation coefficient CC
        *P1--9 = CC
END (IF)
IF (L2 > 2)
        Compute next correlation coefficient CC
        *P2--9 = CC
END (IF)
IF (L2 > 3)
        Compute next correlation coefficient CC
        *P3--9 = CC
END (IF)
IF (L2 = 0)
        L1 = L1−1
        L2 = 4
ELSE
        L2 = L2−1
END (IF)
        L3 = L3+1
IF (L3 = 5)
        L3 = 0
        M1 = M1 − M2 Update starting addresses for next
diagonal
END (IF)
IF (L1 == 0 && L2 == 0) BREAK
END (WHILE)
Copy upper half of rr00 to lower half
Copy upper half of rr11 to lower half
Copy upper half of rr22 to lower half
Copy upper half of rr33 to lower half
Copy upper half of rr44 to lower half
```

(End of computation and construction of autocorrelation matrix using modified storage method.)

Thus, according to the foregoing pseudo-code, the upper and lower halves of the sub-matrices are computed at different times. As previously stated, the structure illustrated in FIG. 6 is merely exemplary, and the sub-matrices may be stored in memory in any order, even in separate banks of memory, as long as each is in a 64 word space and the starting address of each is known.

In the prior art, a search process for the codebook is implemented using the following vectors (in pseudo-code):

| | |
|---|---|
| POS_MAX[5] | contains 5 maximum correlation position indices (0–39); |
| IPOS[10] | contains initial starting position (track numbers) (0–4); |
| I[10] | contains pulse indicators (0–39). |

According to the modified storage and search method of the present invention, the above vectors are modified to correspond to the track-based system as follows:

| | |
|---|---|
| POS_MAX[5][2] | contains 5 maximum correlation positions expressed in track and offset numbers; |
| IPOS[10] | contains 10 initial starting track numbers (0–4) (offset is 0 in this case); |
| I[10][2] | contains pulse indices expressed as track and offset numbers. |

For example, if , in the prior art 40×1 cross-correlation vector, the maximum correlation index is 35, i.e., position 35 of the vector, it can be expressed as [0,7], referring to track 0 and offset, or element, 7, in the method of the present invention.

FIGS. 9*a* and 9*b* show mapping matrices M3 and M4 which may be used for the search procedure. As will be apparent from a review of mapping matrix M3, each x,y (track number)combination is repeated, appearing twice for each combination where x≠y. For example, submatrix &rr[0][1] appears in the first column 910 (second row) and in the second column 920 (first row). Referring now to FIG. 9*b*, the corresponding positions, first column, second row and second column, first row have a "1" and a "0", respectively. The "1" means that the sub-matrix is transposed. In a correlation of the mapping matrices M3 and M4, in the first column, second row, sub-matrix &rr[0][1] becomes &rr[1][0] because it is transposed. In second column, first row, sub-matrix &rr[0][1] is not transposed, as indicated by the "0" in the corresponding location of mapping matrix M4. Thus, only one sub-matrix need be stored to provide the equivalent storage capacity of two sub-matrices.

In a pulse search, the correlation coefficients of two tracks are used to compute the weight of a particular pulse position. At position (X,Y), "X" corresponds to track $X_t$ and offset $X_o$, and "Y" corresponds to track $Y_t$ and offset $Y_o$. In the search, algorithm X is read from vector IPOS (referring back to the pseudo-code) and Y is read from vector l. Thus, track number $X_t$ falls within the range of 0 to 4, and $X_o$ is 0. Track number $Y_t$ is within the range of 0 to 4 and $Y_o$ is in the range of 0 to 7. The correlation matrix is first obtained by computing:

$$\text{Offset}=X_t*5+Y_t.$$

The corresponding correlation sub-matrix address is obtained from M3[Offset] and the read direction is obtained from M4[Offset].

A direction of "0" means that the correlation vector of interest lies along the rows of the target correlation sub-matrix and a direction of "1" means that it should be read along the columns. The Offset value $Y_o$ is used as a row offset (direction "0") or column offset (direction "1"), depending on the value of the direction variable.

FIG. 10 provides an examples of applications of the above technique for a sub-matrix with address indices 0–63. Using the Offset equation from above, with a direction of 0 and an offset $Y_o$ of 5, the required correlation vector lies in the sixth row of rows 0–7 . Addresses 40–47 provide the position indices for the required correlation vector, as indicated by reference numeral 950. For a direction of "1", the correlation vector will be found along the columns, with an offset of 5, so that the correlation vector is found in the sixth column of columns 0–7, consisting of indices 5, 13, 21, 29, 37, 45, 53, and 61, indicated by reference numeral 960. Once the correlation vector is found, the search procedure for the maximum correlation position is that same as in the original, prior art algorithm.

The above-described alternative storage and searching procedures for codebooks and similar autocorrelation techniques may be used to substitute a plurality of sub-matrices for a larger N×N Toeplitz-type correlation matrix to reduce the storage requirements without compromising the advantages of a relatively simple addressing scheme. The number of sub-matrices is determined by the number of tracks T which may be defined within the N×N matrix, with the tracks being defined as equal-sized subsets of N, each of which include a unique set of elements of the N×N matrix. For example, a 100×100 Toeplitz-type correlation matrix with 10,000 coefficients could, using ten tracks, be converted into fifty-five 10×10 sub-matrices containing 5,500 coefficients. The sub-matrices could be divided amongst ten columns of ten full or partial sub-matrices each.

Other embodiments and modifications of the present invention will occur readily to those skilled in the art in view of these teachings. Therefore, this invention is to be limited only by the following claims.

I claim:

1. A memory connected to a correlator in an ACELP codec for storage of an N×N correlation matrix comprising a plurality of correlation coefficients calculated by the correlator, wherein the N×N correlation matrix is a Toeplitz-type matrix having symmetry along a main diagonal and wherein the N×N correlation matrix has an x-axis and a y-axis, the memory comprising:

a plurality of tracks having a quantity T corresponding to an integral fraction of N, each track of the plurality of tracks defining a unique sub-set of N;

a plurality of sub-matrices, each sub-matrix having N/T×N/T positions for receiving a subset of the plurality of correlation coefficients, each sub-matrix being defined by an autocorrelation of two tracks of the plurality of tracks, the two tracks comprising one of an autocorrelation of each track of the plurality of tracks to itself and an autocorrelation of each track of the plurality of tracks to at least a portion of the other tracks of the plurality of tracks;

a plurality of mapping matrices, at least one mapping matrix containing the plurality of sub-matrices in an arrangement of T rows and T columns; and a pointer for connecting one location selected from the T rows and T columns to the correlator whereby the sub-set of the plurality of correlation coefficients is stored in the sub-matrix corresponding to the one selected location.

2. The memory of claim 1, wherein the N×N correlation matrix is a 40×40 matrix computed by autocorrelation of a 40 sample weighted impulse response vector obtained from a 40 sample sub-frame from a speech signal, the 40 sample weighted impulse vector having a sign vector incorporated.

3. The memory of claim 2, wherein the quantity T is five and wherein each of the plurality of sub-matrices is an 8×8 matrix.

4. The memory of claim 3, wherein the plurality of sub-matrices comprises fifteen sub-matrices.

5. The memory of claim 4, wherein the pointer is a five-position multiplex switch.

6. The memory of claim 5, wherein the five-position multiplex switch selects the T columns incrementally beginning at a first column of the T columns.

7. The memory of claim 3, wherein the plurality of sub-matrices contain 960 correlation coefficients.

8. The memory of claim 1, wherein at least one of the T columns includes a plurality of partially-filled sub-matrices.

9. The memory of claim 8, wherein the plurality of mapping matrices includes a structure matrix for correlation with the at least one mapping matrix for defining which of the T columns includes partially-filled sub-matrices.

10. The memory of claim 1, wherein the pointer includes a mapping function which causes the plurality of sub-matrices within a selected column to be filled in a reiterative incremental sequence.

11. The memory of claim 10, wherein the pointer causes each of the plurality of sub-matrices within the selected column to be filled beginning at position [7,7] and proceeds to position [6,6] after position [7,7] of each of the sub-matrices within the selected column has been filled.

12. The memory of claim 1, wherein the pointer comprises a mapping function.

13. In an ACELP codec for implementation in a digital signal processor for storage of an N×N correlation matrix within a digital signal processor memory, the N×N correlation matrix comprising a plurality of correlation coefficients calculated by a correlator, wherein the N×N correlation matrix is a Toeplitz-type matrix having symmetry along a main diagonal and wherein the N×N correlation matrix has an x-axis and a y-axis, a memory comprising:

a plurality of sub-matrices, each sub-matrix being an N/T×N/T matrix, where T is a number of tracks defined in the N×N correlation matrix for each of the x-axis and the y-axis, wherein each sub-matrix contains a subset of the plurality of correlation coefficients; and at least one mapping function for operation on the plurality of sub-matrices, the at least one mapping function designating a configuration of each sub-matrix, wherein the operation of the mapping function on the plurality of sub-matrices provides means for analyzing each correlation coefficient of the plurality of correlation coefficients while storing fewer than N×N correlation coefficients in the digital signal processor memory.

14. The memory of claim 13, wherein the at least one mapping function provides means for selecting one of an upper portion and a lower portion of a sub-matrix for storage of the correlation coefficients in the digital signal processor memory.

15. The memory of claim 13, wherein the at least one mapping function provides means for transposing selected sub-matrices from the plurality of sub-matrices for searching of the correlation coefficients in the digital signal processor memory.

16. The memory of claim 13, wherein the plurality of sub-matrices are arranged within a mapping matrix having T×T elements.

17. The memory of claim 16, further comprising a pointer for selectively addressing each of the T×T elements of the mapping matrix.

18. A method performed in a digital signal processor having a memory and correlator, the method for storing and searching an autocorrelation matrix in an EFR-ACELP codec implemented in the digital signal processor, the correlator for computing a plurality of correlation coefficients for generating the autocorrelation matrix from a 40 sample weighted impulse response signal obtained from a 40 sample subframe, the method comprising:

dividing the 40 sample subframe into five tracks, each track comprising a set of eight pulse positions spaced five pulse positions apart from a preceding pulse position, each track having a unique set of eight pulse positions;

defining a set of fifteen sub-matrices based on an autocorrelation of each track of the five tracks to itself and on an autocorrelation of each track to at least a portion of the other tracks, each sub-matrix being an 8×8 matrix;

defining a first mapping matrix having five columns and five rows, each column comprising five at least partially filled sub-matrices of the set of fifteen sub-matrices;

defining a second mapping matrix containing structure information for correlating with the first mapping matrix for determining a configuration of the at least partially filled sub-matrices; and addressing a location corresponding to a column and row combination, each location corresponding to one of the at least partially filled sub-matrices, for connecting the correlator to a position within each at least partial sub-matrix.

19. A method of claim 18, wherein the five at least partially filled sub-matrices within the first column of the five columns are completely filled with correlation coefficients and each subsequent column contains fewer correlation coefficients than in the first column.

20. The method of claim 18, wherein the step of addressing includes filling each of the at least partially filled sub-matrices within the selected column beginning at a position [7,7] and proceeding to a position [6,6] after the position [7,7] of each of the at least partially filled sub-matrices within the selected column has been filled.

21. The method of claim 18, wherein the fifteen sub-matrices contain 960 correlation coefficients.

22. The method of claim 18, wherein the second mapping matrix contains a plurality of designators for selecting a pre-determined portion of each sub-matrix.

23. The method of claim 22, wherein the plurality of designators select one of an upper portion or a lower portion of each sub-matrix.

24. The method of claim 18, wherein the second mapping matrix contains a plurality of ones and zeroes for indicating transposition or not of a selected sub-matrix.

* * * * *